US006648172B2

(12) United States Patent
Leighton et al.

(10) Patent No.: US 6,648,172 B2
(45) Date of Patent: Nov. 18, 2003

(54) TISSUE BOX

(76) Inventors: Daniel Leighton, 14, Hallin Court, Ardross, Western Australia 6153 (AU); Angela Mary Leighton, 14, Hallin Court, Ardross, Western Australia 6153 (AU)

( * ) Notice: Subject to any disclaimer, the term of this patent is extended or adjusted under 35 U.S.C. 154(b) by 0 days.

(21) Appl. No.: 10/168,359

(22) PCT Filed: Jan. 17, 2001

(86) PCT No.: PCT/AU01/00041

§ 371 (c)(1),
(2), (4) Date: Jun. 19, 2002

(87) PCT Pub. No.: WO01/53168

PCT Pub. Date: Jul. 26, 2001

(65) Prior Publication Data

US 2003/0057224 A1 Mar. 27, 2003

(30) Foreign Application Priority Data

Jan. 20, 2002 (AU) ..... PQ 5193

(51) Int. Cl.[7] ..... B65H 1/00

(52) U.S. Cl. ..... 221/35; 221/34; 221/63; 221/47; 221/48; 206/233; 206/555

(58) Field of Search ..... 221/35, 34, 63, 221/47, 48; 206/233, 555

(56) References Cited

U.S. PATENT DOCUMENTS

| | | | | | |
|---|---|---|---|---|---|
| 3,095,087 | A | * | 6/1963 | Yates | 206/449 |
| 4,469,243 | A | * | 9/1984 | Ito et al. | 221/34 |
| 5,129,545 | A | * | 7/1992 | Parks | 221/34 |
| 5,143,249 | A | | 9/1992 | Saint Criq et al. | |
| 5,265,758 | A | | 11/1993 | Saint Criq et al. | |
| 5,332,117 | A | | 7/1994 | Yadegar | |
| 5,540,354 | A | * | 7/1996 | Annand | 221/52 |
| 5,622,281 | A | * | 4/1997 | Annand | 221/48 |
| 6,296,143 | B1 | * | 10/2001 | Ghabriel | 221/34 |
| 6,349,849 | B1 | * | 2/2002 | Pehr | 221/33 |
| 6,427,839 | B1 | * | 8/2002 | Helfer-Grand | 206/494 |

FOREIGN PATENT DOCUMENTS

| | | |
|---|---|---|
| EP | 382809 | 5/1993 |
| FR | 2632844 | 6/1988 |
| WO | WO 89/12418 | 12/1989 |
| WO | WO 94/20397 | 9/1994 |

* cited by examiner

*Primary Examiner*—Donald P. Walsh
*Assistant Examiner*—Matthew J. Kohner
(74) *Attorney, Agent, or Firm*—Kohn & Associates, PLLC

(57) ABSTRACT

A tissue box (10) for dispensing tissues, said tissue box includes a bottom wall (18) having a second aperture (21) for allowing tissues (22, 22') to be pulled from inside of the box and a side wall (14) extending between the top wall (16) and the bottom wall (18). The side wall defines a void inside the box for containing tissues. The tissue box also includes a dividing wall (24) within the void. The dividing wall is supported between the top wall and the bottom wall and is for dividing the tissues into a first group (22) that are able to be removed through the first aperture (20) and a second group (22') that are able to be removed through the second aperture. In use, after the first group of tissues is used, the box may be inverted, so that the second group of tissues may be used.

10 Claims, 2 Drawing Sheets

TISSUE BOX

CROSS-REFERENCE TO RELATED APPLICATIONS

This patent application is a National Phase Concerning a Filing Under 35 U.S.C. 371, claiming the benefit of priority of PCT/AU01/00041, filed Jan. 17, 2001, which claims the benefit of priority of Australian Provisional Patent Application No. PQ5193, filed Jan. 20, 2000, all of which are incorporated herein by reference.

FIELD OF THE INVENTION

The present invention relates to a tissue box for dispensing tissues.

BACKGROUND OF THE INVENTION

Tissue boxes, for dispensing tissues are well known. However, current tissue boxes suffer from problems, particularly in the case of larger sized tissue boxes, when there is only a minority of tissues remaining in the box. There is a tendency for the next tissue (which should be protruding from the aperture) to drop back into the box. The user must put a hand through the aperture into the box to remove a tissue to restart the run of tissues. This can be quite difficult especially if a tissue is needed in a hurry and often results in a number of tissues coming out, which is wasteful. If this only happened a few times in the life of the box it would be acceptable, but as the pile of tissues remaining in the box, particularly with larger sized boxes, reduces from about half to one third remaining, the problem gradually gets worse until the last 20% or 10% of tissues result in a failure of continuity for most of the remaining tissues. Due to the distance between the aperture at the top of the box and the base of the box where the tissues rest, a large portion of the protruding tissue is not supported by the base. Consequently, the weight of this unsupported portion often causes the tissue to fall back into the box.

For economy and other reasons it is desirable to put a large number of tissues in the one box. However, this necessarily increases the size of box and exacerbates the above mentioned problem.

There have been some attempts to overcome this problem in the past, these include having the underneath of the box able to be pushed upwardly so as to reduce the height between the tissues and the aperture. However, this solution is generally unreliable, ineffective and costly.

BRIEF SUMMARY OF THE INVENTION

An object of the present is to provide a tissue box which provides a new means of overcoming the above mentioned problem.

According to the present invention there is provided a tissue box for dispensing tissues, said tissue box including:

- a top wall having a first aperture for allowing tissues to be pulled from inside of the box;
- a bottom wall having a second aperture for allowing tissues to be pulled from inside of the box;
- a side wall extending between the top wall and the bottom wall, the side wall defining a void inside the box for containing tissues; and
- a dividing means within the void, supported between the top wall and the bottom wall for dividing the tissues into a first group that are able to be removed through the first aperture and a second group that are able to be removed through the second aperture, whereby, in use, after the first group of tissues is used, the box may be inverted, whereupon the second group of tissues may be used.

Preferably the dividing means is in the form of a dividing wall. More preferably the dividing means is arranged to be supported by a support means, such that the weight of the second group of tissues does not significantly sag the dividing means too far from the aperture. More preferably the dividing means is positioned approximately half to two thirds of the way between the top wall and the bottom wall.

Preferably, the dividing means is connected to the side wall. More preferably the dividing means is supported by longitudinally extending flaps that are folded down in between the folded end flaps of the box. Alternatively, the dividing means is provided by a second tissue box with both bottom walls for each tissue box secured to one another. In another embodiment the dividing means is provided by the base of a first box attached to a side wall of a bottomless second box. In yet another embodiment, the dividing means is part of a self supporting insert.

Preferably, the side wall is comprised of opposed end walls and opposed lateral walls, arranged to form a rectangle.

BRIEF DESCRIPTION OF DRAWINGS

In order to provide a better understanding, preferred embodiments of the present invention will be described in greater detail, by way of example only, with reference to the accompanying drawings, in which.

DETAILED DESCRIPTION OF THE PREFERRED EMBODIMENT

Figure 1:
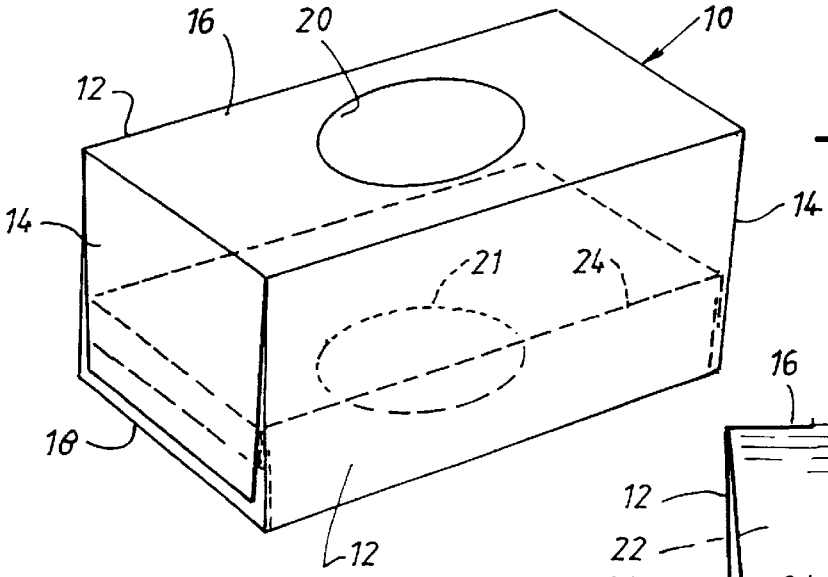
FIG. 1 is an upper perspective view of a first embodiment of a tissue box according to the present invention.

Referring to FIG. 1, there is shown a tissue box 10 which includes opposed lateral walls 12, opposed end walls 14, a bottom wall 18 and a top wall 16. The walls are arranged in a standard rectangular prism shape of an ordinary tissue box. The top wall includes an aperture 20 through which tissues 22 may be drawn from the inside of the box.

The box is also provided with a dividing floor 24 intermediate the bottom wall 18 and the top wall 16. The floor 24 is approximately one half to two thirds of the way between the top wall 16 and the bottom wall 18. In addition, opposite the first aperture 20 is a second aperture 21 in the bottom wall 18.

Figure 3:
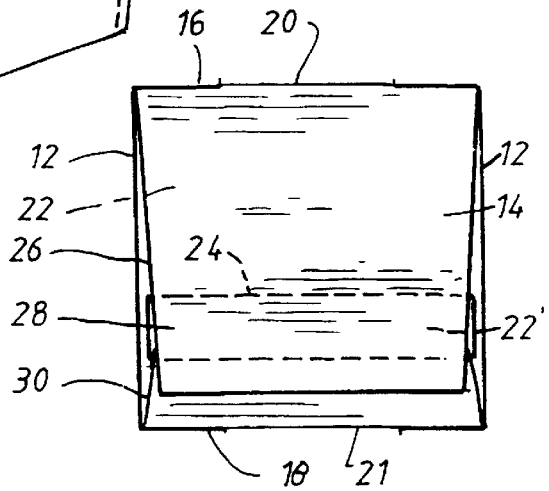
FIG. 3 is an end view of a tissue box of FIG. 1.
Figure 2:
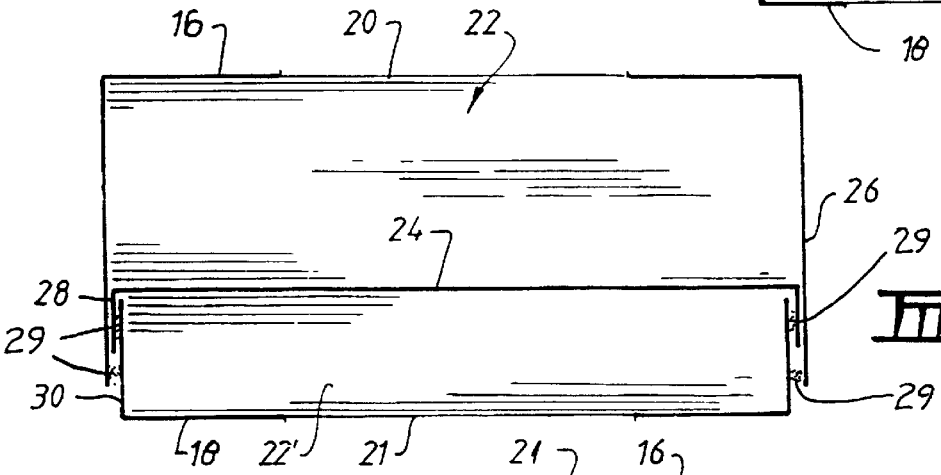
FIG. 2 is a side view of the tissue box of FIG. 1.

Referring to FIGS. 2 and 3, the floor 24 is provided with end flaps 28 at each end of the box. The flaps 28 overlap with flaps 30 from the bottom wall 18 of the box. A further flap 26, from the top wall, overlaps the flap 28. These are then secured in place with adhesive 29. This arrangement provides two compartments, within which a first group of tissues 22 is able to be supported on the floor 24, and a second group of tissues 22' located beneath the floor 24.

When the top wall 16 is above the bottom wall 18, that is, when the box is right way up, the floor 24 is provided with support due to the floor 24 resting on the ends of the flaps 30. Additional support is provided by the second group of tissues 22' being beneath the floor 24.

When the first group of tissues 22 has been removed, the tissue box may inverted. The second group of tissues 22' is then accessed through to second aperture 21. The floor 24 may sag a little as it is not supported from underneath. However, since the second group of tissues is less than the first group and the distance from the floor 24 to the aperture 21 is also less, the sagging is not significant.

Figure 4:
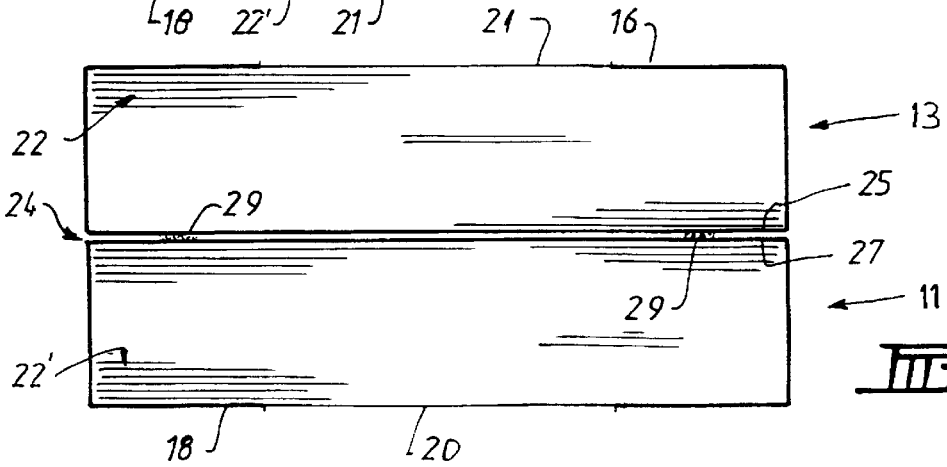
FIG. 4 is a side view of a second embodiment of a tissue box in accordance with the present invention.

In FIG. 4 another embodiment of the tissue box 10 comprises two small tissue boxes 11 and 13 which are coupled together by adhesive 29 at a bottom wall 27 of the first box 11 and bottom wall 25 of the second box 13. In this case, the floor 24 comprises the walls 25 and 27.

Figure 5:
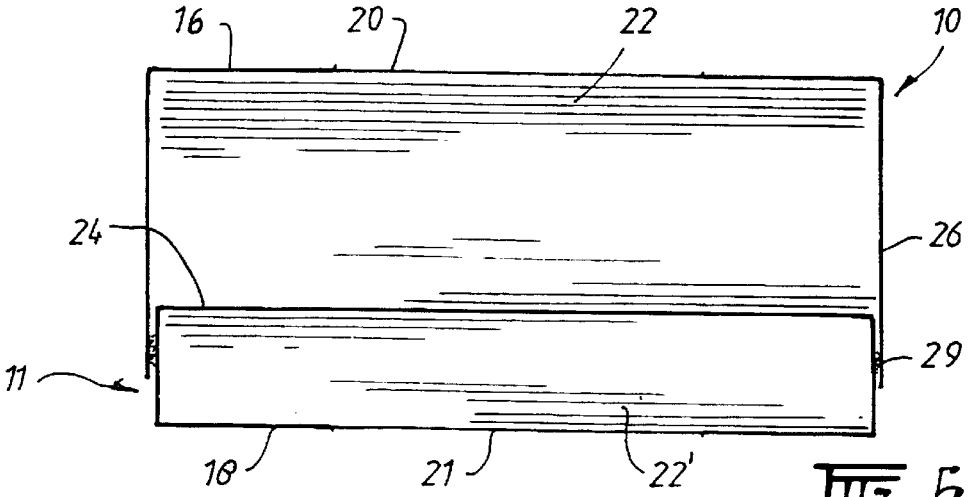
FIG. 5 is a side view of a third embodiment of a tissue box in accordance with the present invention.

Referring to FIG. 5, in this embodiment a smaller box 11 is at the bottom of the tissue box 10 and the top wall 16 and sides are formed by wall portions 26 which are secured by adhesive 29 to the end walls and side of the smaller box 11. The floor 24 is formed of the bottom wall of the smaller box 11.

Figure 6:
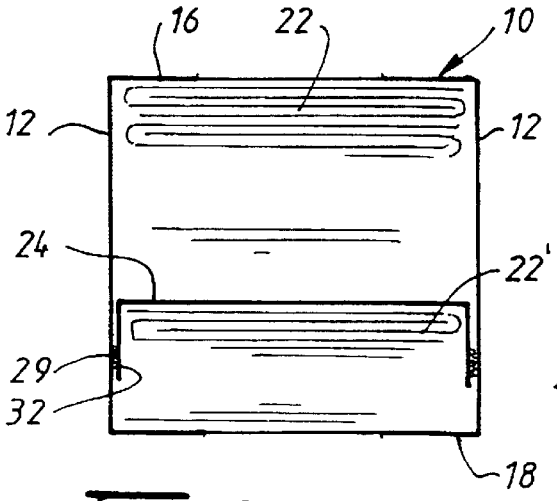
FIG. 6 is an end view of a fourth embodiment of a tissue box in accordance with the present invention.

Referring to FIG. 6, in this embodiment the box 10 is made from a large box with an insert forming the floor 24. The insert is fixed to the lateral walls, rather than the end walls by a flap 32 of the floor 24. The flap 32 is secured to the lateral walls 12 by adhesive 29.

Figure 7:
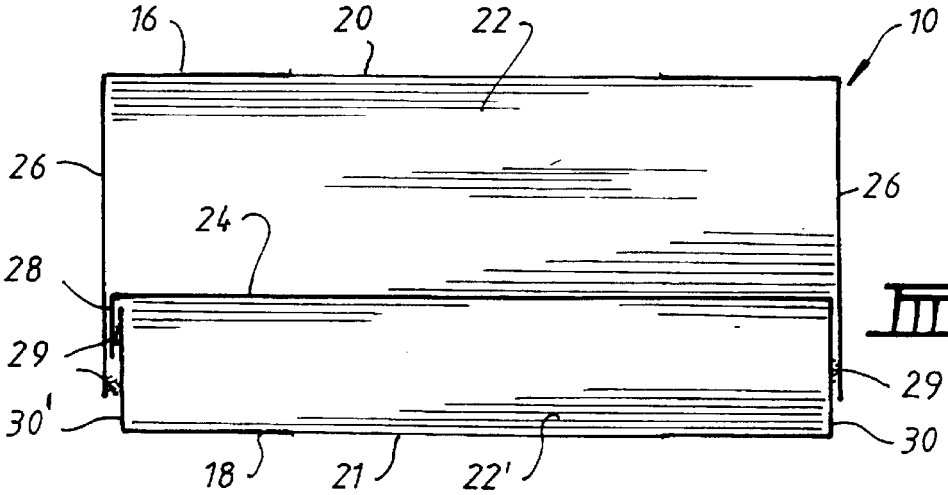
FIG. 7 is a side view of a fifth embodiment of a tissue box in accordance with the present invention.

Referring to FIG. 7, in this embodiment the floor 24 of the box 10 is contiguous with one of the flaps 30 from the bottom wall 18. The floor 24 extends across the length of the box whereupon a flap 28, at one end of the floor 24, then overlaps the other flap 30' and is secured by adhesive 29. Flaps 26 from the top wall then overlap the first flap 30 and the second flap 30', which are secured with adhesive 29.

Figure 8:
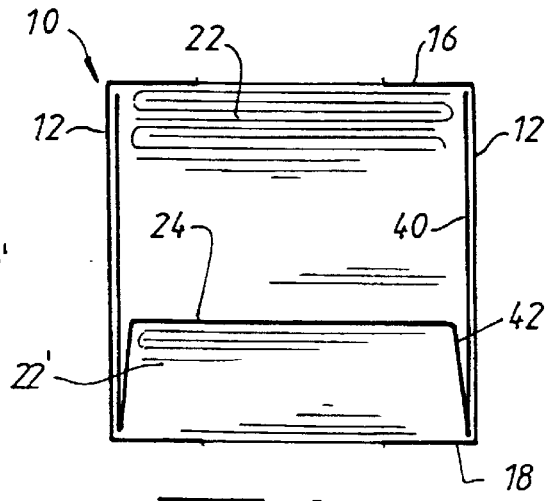
FIG. 8 is an end view of a sixth embodiment of a tissue box in accordance with the present invention.

Referring to FIG. 8, in this embodiment the floor 24 is part of an insert 40 in the box which has inner side walls 42 that extend towards the bottom wall 18. These support the floor 24 in the box when it is in the upright position. There is a fold at the bottom of the inner side walls which continues with an upper portion 40 that supports the floor 24 above the upper wall 16 when in the inverted position.

It is desirable that the second group of tissues 22' be smaller than the first group of tissues 22 so that when the box is inverted, there is less weight on the floor which then is no longer supported underneath by a stack of tissues. Furthermore, it is normal for there to be some form of decoration and/or advertising on the tissue box. It is less desirable to have this upside down for the majority of the duration of use of the box.

Now that the preferred forms of the present invention have been described, it will be clear that the present invention has at least the following advantages:

Tissues near the bottom of the box will be closer to the second aperture after inversion of the box and will be readily and continuously removable. In addition, the support means for supporting the artificial floor may be incorporated into the tissue box with minimal additional cost in manufacture and loading of the box.

It will be clear to the skilled addressee that modifications and variations can be made to the present invention without departing from the basic inventive concept. There may be other configurations for supporting the floor and construction of the box. Such modifications and variations are intended to be within the scope of the present invention the nature of which is to be determined from the foregoing description.

What is claimed is:

1. A tissue box for dispensing tissues, said tissue box including:

a top wall having a first aperture for allowing tissues to be pulled from inside of the box;

a bottom wall having a second aperture for allowing tissues to be pulled from inside of the box;

a side wall extending between the top wall and the bottom wall, the side wall defining a void inside the box for containing tissues; and a dividing means within the void, supported between the top wall and the bottom wall for dividing the tissues into a first group that are able to be removed through the first aperture and a second group that are able to be removed through the second aperture, whereby, in use, after the first group of tissues is used, the box may be inverted, whereupon the second group of tissues may be used.

2. The tissue box according to claim 1, wherein the dividing means is in the form of a dividing wall.

3. The tissue box according to claim 1, wherein said dividing means is arranged to be supported by support means such that the weight of the second group of tissues does not significantly sag said dividing means.

4. The tissue box according to claim 1, wherein said dividing means is positioned approximately one-half to two-thirds of the way between the top wall and the bottom wall.

5. The tissue box according to claim 1, wherein said dividing means is connected to the side wall.

6. The tissue box according to claim 1, wherein said dividing means is supported by longitudinally extending flaps that are folded down in between the folded end flaps of the box.

7. The tissue box according to claim 1, wherein said dividing means is provided by a second tissue box with both bottom walls for each tissue box secured to one another.

8. The tissue box according to claim 1, wherein said dividing means is provided by the base of a first box attached to a side wall of a bottomless second box.

9. The tissue box according to claim 1, wherein said dividing means is pail of a self-supporting insert.

10. The tissue box according to claim 1, wherein said side wall is comprised of opposed end walls and opposed lateral walls, arranged to form a rectangle.

* * * * *